US007521654B2

(12) United States Patent
Heinrich et al.

(10) Patent No.: US 7,521,654 B2
(45) Date of Patent: Apr. 21, 2009

(54) HEATER PANEL OF A RADIANT HEATER COMPROMISING A HEATING SPIRAL

(75) Inventors: Hans-Juergen Heinrich, Kleinroehrsdorf (DE); Hubertus Von Der Waydbrink, Dresden (DE)

(73) Assignee: Von Ardenne Anlagentechnik GmbH, Dresden (DE)

( * ) Notice: Subject to any disclaimer, the term of this patent is extended or adjusted under 35 U.S.C. 154(b) by 279 days.

(21) Appl. No.: 11/620,860

(22) Filed: Jan. 8, 2007

(65) Prior Publication Data

US 2007/0175889 A1 Aug. 2, 2007

(30) Foreign Application Priority Data

Jan. 6, 2006 (DE) ..... 10 2006 001 151

(51) Int. Cl.
*H05B 1/02* (2006.01)

(52) U.S. Cl. ..... 219/520; 219/538; 219/390; 219/393; 219/548

(58) Field of Classification Search ..... 219/461.1, 219/520, 532, 536, 537, 538, 390, 393, 407, 219/546, 548; 117/81, 83, 223
See application file for complete search history.

(56) References Cited

U.S. PATENT DOCUMENTS 4,713,527 A * 12/1987 Kicherer et al. ..... 219/461.1
4,789,773 A * 12/1988 Mikschl ..... 219/461.1

FOREIGN PATENT DOCUMENTS

DE 37 35 179 5/1989

* cited by examiner

*Primary Examiner*—Mark H Paschall
(74) *Attorney, Agent, or Firm*—Heslin Rothenberg Farley & Mesiti PC; Victor A. Cardona, Esq.

(57) ABSTRACT

A heater panel of a radiant heater includes a heating spiral provided on a panel element and mechanically connected to the panel element with a portion of a spiral turn. With the object of providing a heater panel with a stable arrangement of the heating spiral on the panel element by which a high power density is achievable, each spiral turn is detachably connected to the panel element by three spaced-apart contact spots. Two of said contact spots are located on the outer circumference of the spiral turn in such a distance to each other that the radii originating at them define an angle of less than 180°, and the third contact spot is located on the inner circumference of the spiral turn within the portion of the spiral turn facing the panel element and confined by the two outer contacts.

12 Claims, 4 Drawing Sheets

HEATER PANEL OF A RADIANT HEATER COMPROMISING A HEATING SPIRAL

BACKGROUND ART

The invention relates to the technical sector of the winding of a textile yarn on a holder, generally in the form of a cylindrical mandrel capable of being driven in rotation. The cylindrical mandrel, or holder, can be driven in rotation either via its axis or via one of its generatrices. This winding can be used for spinning, drafting, texturing, torsion, assembling and reeling operations, etc.

The invention relates to the heater panel of a radiant heater comprising a heating spiral mechanically connected to a panel element with a portion of the spiral turn facing the panel element of the heater panel.

Radiant heaters are used in various fields. They are designed to radiate thermal energy to heat a body without being in direct contact with it, i.e. to transmit thermal energy by radiation. To radiate the heat two-dimensionally and to thereby heat largely dimensioned bodies or numerous bodies arranged on a plane radiant heaters are frequently realised as heater panels.

Such panel heating elements are particularly known for a wide variety of furnaces, for example for annealing furnaces as well as for baking oven muffles and also for cooking plates. In vacuum plants as well panel heating elements are used, for example for heating substrates to be coated. They substantially comprise a panel element on which heating means such as a heating resistor or a heating conductor are disposed. To obtain the highest possible power density, i.e. the highest possible heating power per surface area, the heating means are arranged on the panel element in a meander or spiral shape. In this case, however, the two-dimensional arrangement of the heating means and the minimum distance between the heating conductors resulting from the electric operational parameters limit the power density. A higher power density can be achieved by arranging a heating helix the heating means of which is spiral-shaped and usually has a uniform ascending gradient on the panel element.

According to DE 37 35 179 A1 a spiral-shaped heating helix is arranged on the complete surface of a circular panel element. To fix the heating helix to the panel element a part of each turn of a segment of the helix is embedded in a material applied to the panel element whereby it is fixed thereon. In this case it is, however, problematic that high stresses build up in the heating means and the panel element due to the different thermal expansion of the heating means and the panel element as well as due to the fixation which may lead to damage up to a failure of the heater.

Furthermore the non-embedded portions of the turns and the unfixed segments of the heating helix are movable so that, particularly in case of a thermal expansion, they deform such that the turns which are disposed nearly orthogonally on the panel element will tilt and therefore come closer so that a flashover will occur. This problem can be alleviated by an increased ascending gradient of the spiral and thus by a larger distance between the individual turns which is, however, accompanied by a substantial loss of power density. A denser embedding of the heating helix or an increased embedding of the individual turns will also result in a decrease of the power density since only the exposed portions of the heating means contribute to the heating power.

SUMMARY OF THE INVENTION

The invention is therefore based on the object to specify a heater panel providing a stable arrangement of the heating helix on the panel element by which heater panel a high power density can be obtained. For better differentiation, the heating helix shall be referred to as heating spiral below.

Said object is solved by a heater panel in which each spiral turn is detachably connected to the panel element and the mechanical connection between a spiral turn of the heating spiral and the panel element is established by means of three contact spots arranged in intervals two of which (the outer contacts) are disposed on the outer circumference of the spiral turn in such an interval that the radii originating in them define an angle of less than 180° while the third contact spot (the inner contact) is disposed on the inner circumference of the spiral turn within the portion of the spiral turn facing the panel element and defined by the two outer contacts.

Due to the connection by means of three separate contact spots almost all of the heating spiral is exposed and thus contributes to the heating power so that each individual heating spiral can be fixed almost without any loss of heating power. At the same time the spiral turn fixed by the three contact spots is so stably fixed to the panel element in its position as well as in its angular position that it cannot tilt whereby the risk of a flashover and thus of a deterioration of the heater panel is considerably reduced. To increase the power density the heating spiral may therefore be arranged much more densely, exclusively in accordance with the electric parameters and without an additional clearance. This higher density within the heating spiral is possible due to a decreased ascending gradient and, at the same time, due to a smaller distance between adjacent heating spirals.

In addition a relative large portion of the surface of the panel element remains uncovered despite the increased density so that the heating power can be further increased when it is reflective.

Tilting is prevented by the arrangement of the three contact spots in accordance with the invention. The two outer contacts together with the inner contact fix the position of the respective spiral turn on the panel element. Due to the distance between the two outer contacts with corresponds to at least one quarter of the outer circumference and less than half of the circumference the required fixation of the spiral turn in its horizontal position is achieved. A particularly stable horizontal positioning of the individual spiral turns is obtained by an embodiment of the invention in which the angle is greater than or equal to 45° and smaller than or equal to 120°.

Since the connection is only established via the contact spots even an increase of the horizontal distance between the lowest point of the spiral turn and the contact spots up to almost the outer radius of the turn will not result in a deterioration of the heating power which would inevitably occur if the turn were embedded.

According to specific embodiment of the invention, an additional lateral stabilisation of, for example, heating spirals having a relatively large outer diameter, is realised by stabilising at least individual spiral turns of the heating spiral against lateral tilting by means of additional contact spots. Said additional contact spots are positioned on the front and/or rear side of the heating spiral as seen in the direction of its longitudinal dimension and on the portion of the spiral turn facing the panel element (lateral contacts). Such a lateral stabilisation via contact spots may, for example, be implemented by semicircular braces projecting from the panel element. Other designs are feasible as long as they are connected to the spiral turn only by means of the contact spots since in this manner the advantages described above are also obtainable for this connection.

A further important advantage is that the connection can absorb stresses due to the different thermal expansion during the heating and cooling processes only via the contact spots. Particularly due to the detachable connection according to the invention the spiral turn may be shifted with respect to the contact spots independent of the adjacent spiral turns when the diameter of the spiral turn becomes larger or smaller. Due to the fixation of the individual spiral turns in their horizontal position with or without additional lateral contacts such a stress balance is possible without a risky lateral approach of adjacent spiral turns being caused. The spatial balancing occurs only in the horizontal direction without the connection being loosened.

Such a displacement of the spiral turn relative to the contact spots is in particular obtainable in case of contact spots which are as small as possible. In a particularly advantageous embodiment of the invention the contact spots are therefore almost point-like.

The described connection of the heating spiral to the panel element by means of the contact spots also enables a simple, surface-covering combination of one or more heating spirals on the panel element and therefore the switching of different power levels.

According to a further embodiment of the invention the two outer contacts are formed by a slit in the panel element or in a bottom element. The length of said slit being smaller than the outer diameter of the corresponding spiral turn and its width just so much larger than the width of the spiralled material that the spiral turn can be inserted into the slit and the inner contact is formed by a brace-like element extending into the spiral turn and being connected to the panel element or the bottom element.

Here a bottom element is supposed to be a two-dimensional element smaller than the panel element and extending in a direction substantially parallel to the panel element. The arrangement of the bottom element which is parallel to the panel element in one direction includes that the bottom element is curved towards the panel element in the other direction. The parallel direction will here be the one in which the spiral extends longitudinally. The bottom element is connected to the panel element and comprises the slits described. A suitable size of the bottom element or a suitable selection of the material will allow an adjustment of the heating spiral or the heating spirals mounted thereon to the various requirements of the heating panel. Since, according to this embodiment, only insignificant structures are required on the panel element to fix the heating spiral a high reflective proportion may be obtained in case of a reflective embodiment of the surface of the panel and/or bottom element.

The outer contact spots are, in this case, formed by the contact points between the panel or bottom element and the spiral turn in the slit and are therefore nearly point-like with the cross-section of the material of the heating means usually being circular. With the selection of the size of the slit the distance of the two outer contact spots is defined in a particularly simple manner. Since the heating spirals regularly have a uniform ascending gradient and a uniform outer diameter the slits usually have the same size and the same distance. In general, however, a connection is also possible in a particularly simple way in case of an irregular ascending gradient and a varying outer diameter. This, by the way, is not limited to the present embodiment but also applicable to the production of contact spots in accordance with another of the methods described herein.

By inserting the spiral turns into the slits the lateral contact spots may be formed simultaneously. Their position will, in this case, advantageously be in the direct vicinity of the outer contacts.

After the insertion of the spiral turns into the slits their fixation by means of the inner contact spot is possible via a brace-like element contacting the spiral turn at its inner circumference and exerting a pressure having an adjustable force on the outer contact spots. In this way a detachable connection is established and the described displacement of the spiral turn to balance stress is enabled. The size of the contact spot, even if it is almost point-like, is adjustable by means of the shape and the cross section of the brace-like element.

It is particularly advantageous when the brace-like element extends through a plurality of adjacent spiral turns and at the same time parallel to the panel element between its first and its last spiral turn. This embodiment enables a simple and rapid fixation of whole sections of a heating spiral or the whole heating spiral by pushing the brace-like elements trough the heating spiral and connecting their ends to the panel element or the bottom sheet.

If according to a specific embodiment of the invention at least a part of the bridges of the bottom element disposed between the slits protrude beyond the surface of the bottom element the brace-like elements may have a substantially longitudinally extending form and extend through the clearance formed between the lower edge of the bridge and the upper edge of the inner circumference of the spiral turn so that the brace-like element has to be secured against a displacement only in its longitudinal direction. The number of the bridges the elevation may include as well as the shape and size of the brace-like elements depend on various aspects. In case of small heating spirals it may, for example, be sufficient to provide such an elevation for the fixation of the single brace-like element only at the front and at the rear end of the spiral. In case of a sufficiently large clearance it is of course generally possible to provide two or three brace-like elements adjacent to each other to fix the heating spiral.

In connection with this kind of fixation of the heating spiral it has been found to be advantageous that the elevation of the bridges and/or the cross section of the brace-like element are selected so that the brace-like element can be inserted in the space with little clearance. The clearance will disappear due to the thermal expansion during heating so that the required stability of the connection is then established.

Instead of the slits the outer contacts may also be formed by outer rod-like elements extending along both sides of the heating spiral and being connected to the panel element. Thus, in addition to the again almost point-like contact spots, a very simple design of the panel element is possible which is adjustable to the respective shape and size of the heating spiral by a simple displacement or bending of the rod-like elements or equally by combining a plurality of such elements. In the same way the inner contacts may be formed by an inner rod-shaped element. It extends through a plurality of spiral turns and is connected to the panel or bottom element in a suitable manner at least at its front and rear end point. This may, for example, also be realised by the elevations of the bridges mentioned above.

According to a further embodiment of the invention lateral contacts are formed by at least two handles connected to the panel element and thus fixing the inner rod-like element in the spiral turn. In case of a correspondingly small ascending gradient of the heating spiral one handle may form the lateral contacts of two adjacent spiral turns. In this case also the additional lateral fixation may be effected at each spiral turn as well as only at the end points and/or at critical transitional sections of the heating spiral.

According to a specific embodiment of the invention the heating spiral is a helical jacket heating tube for the application of the heater panel in vacuum equipments. Such jacket heating tubes are generally three-layered, the core being formed by a resistance wire which may glow for heating. Said wire is surrounded by a thermally stable and well heat-conducting insulating material confined by a jacket pipe consisting of a material having good heat transmission properties towards the outside. In addition to the thus optimised heat dissipation to the environment the jacket surface of the jacket pipe which is significantly enlarged as compared to the resistance wire leads an increased heat dissipation and therefore to an enhanced heating capacity. Since the material of the jacket pipe is more susceptible to stress during the heating and cooling process than conventional heating means the stress-reduced and stress-balancing arrangement according to the invention is particularly suitable for heating spirals formed by jacket pipe heaters.

BRIEF DESCRIPTION OF THE DRAWING FIGURES

The invention is to be explained in detail with reference to an embodiment. In the associated drawings FIG. 1 is a cross sectional view of a heater panel having two heating spirals connected to a panel element by a bottom element according to the present invention;

DETAILED DESCRIPTION

Figure 1:
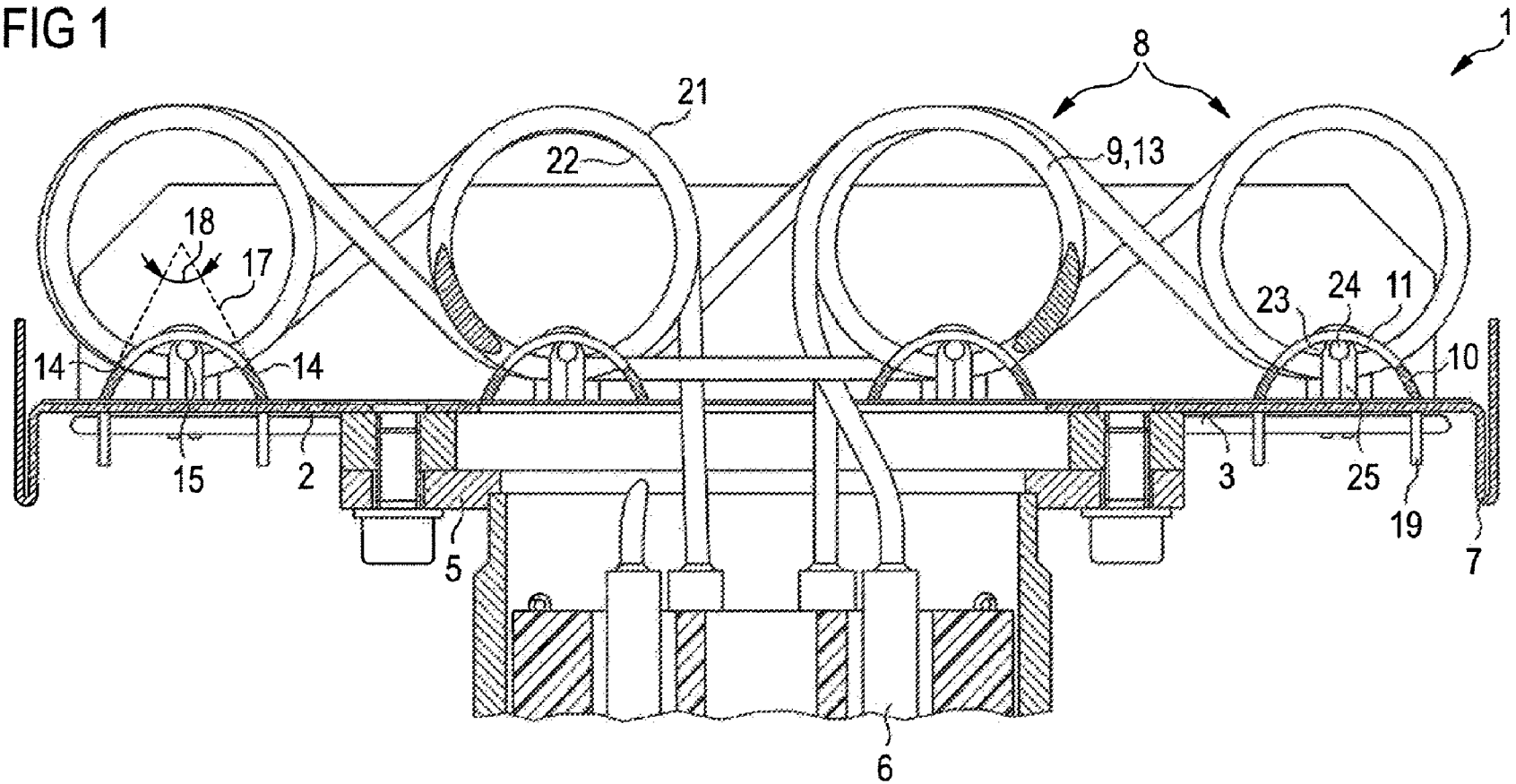
FIG. 1A is a cross sectional view of a heater panel having two heating spirals connected to a panel element by a rod-shaped element according to the present invention.

The heater panel 1 according to FIG. 1 comprises a panel element 2 to the upper surface of which a connector 5 is screwed for electrically connecting the heater panel 1. The panel element 2 is laterally confined by an offset bend 7. On the panel element 2 two uniform heating spirals 8 formed of a jacket pipe are disposed each consisting of two sections 9, a forward and a reverse section, and being connected to electric connecting lines 6.

The four sections of the two heating spirals 8 are fixed to the panel element 2 by means of half-cylinder-shaped bottom elements 10 (FIG. 1). With respect to the panel element 2 the bottom elements 10 are arranged so that their jacket lines extend parallel to the panel element 2. They are provided with a centrally located slit 11 for each spiral turn 13, said slit 11 extending vertically with respect to the jacket lines and having a length of about half of the outer diameter of the spiral turn 13 as measured parallel to the panel element 2. The heating spirals 8 are inserted into the corresponding slit 11 -with each of their spiral turns 13 so that the spiral turns 13 and the bottom element 10 contact each other only at the ends of the respective slit 11. These contact points are the outer contacts 14. Due to the length of the slits 11 radii 17 originating at the outer contacts 14 form an acute angle which is, however, larger than 45°, Each bottom element 10 is provided with segments 19 fixed in corresponding elongated apertures 20 of the panel element 2 at its bottom side in the extension of the jacket surface. The half-cylinder-shaped bottom elements 10 have such a curvature that the spiral turns 13 positioned in the slits 11 do not contact the panel element 2 and that a clearance 23 is formed between the bottom surface of the bottom element 10 as regarded relative to the plane of the drawing and the lowest point of the inner circumference 22 of the spiral turn. Such a clearance 23 is equally formed at each spiral turn 13. A common straight wire 24 is inserted into all clearances 23 of a section of a heating spiral 9, the length of said wire being larger than one section of a heating spiral 9 so that it may be connected to the panel element 2 at both ends of the section 9 by means of a hook 25, respectively. In this way the sections of the heating spirals 9 are fixed on the bottom element 10 by a brace element formed by said wire 24 in described embodiment and therefore the bottom element 10 is additionally fixed on the panel element 2.

Figure 1A:
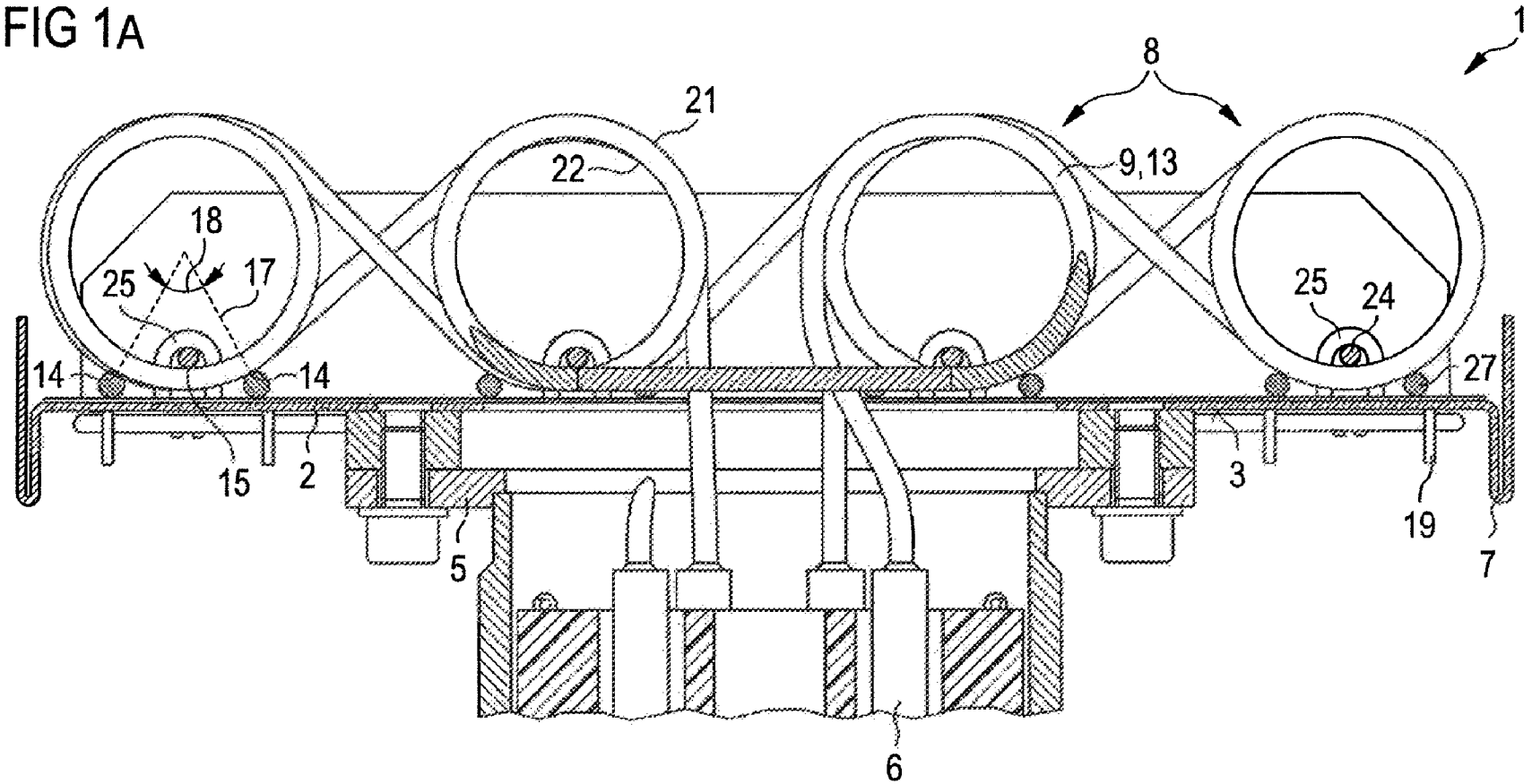

The contact spot between the wire 24 and the inner circumference 22 of the spiral turn 13 forms the inner contact 15. The lateral contacts 16 which are not shown in this figure form the lateral contact points between the jacket pipe and the bridge 12 of the bottom element 10 provided between the slits 11. Due to the circular cross section of the jacket pipe alone all contacts 14, 15, 16 are almost point-like. In another example, instead of the slits 11 in the bottom element 10, the outer contacts 14 may also be formed by outer rod-shaped elements 27 extending along both sides of the heating spiral 8 and being connected to the panel element 2 (FIG. 1A). In the same way the inner contacts 15 may be formed by an inner rod-shaped element 28. Like the wire 24, the inner rod-shaped element 28 extends through a plurality of spiral turns 13 and is connected to the panel element 2 or the bottom element 10 in a suitable manner at least at its front and its rear end point.

Figure 2:
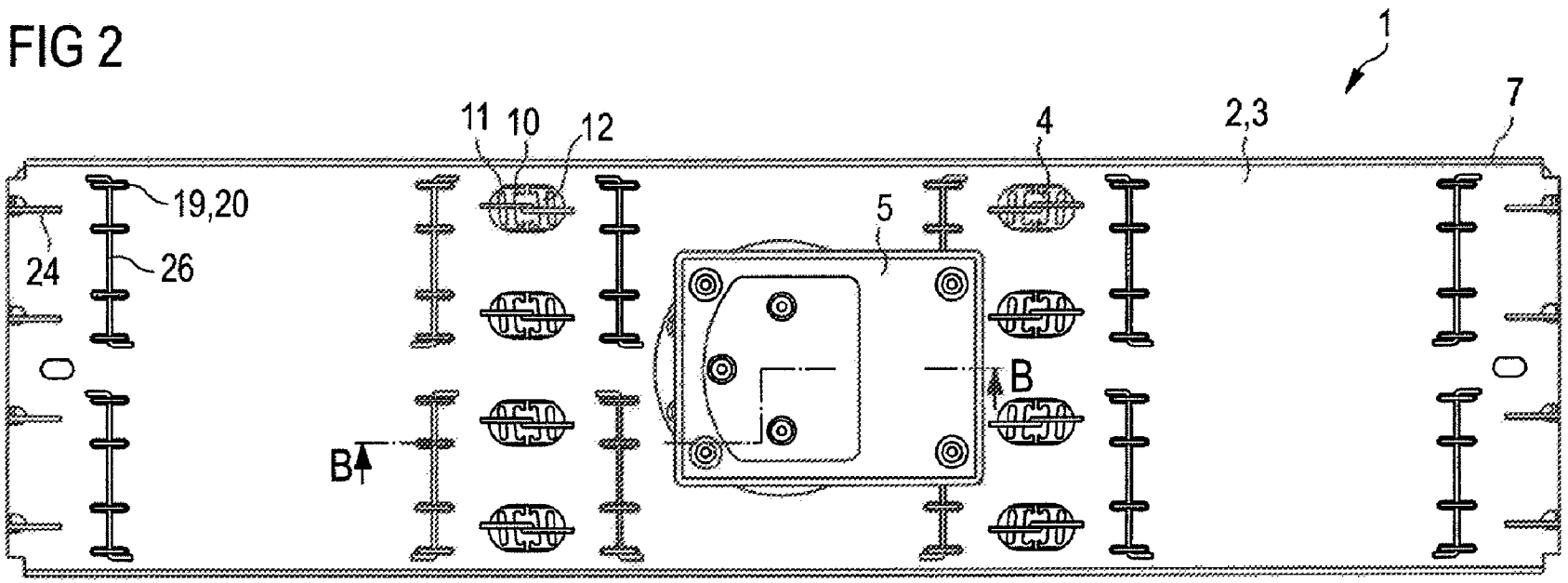
FIG. 2 shows a bottom view of a heater panel.

FIG. 2 is a view of a heater panel 1 from the side of the panel element 2. The connector 5 is mounted on the panel element 2. On the averted side of the panel element 2 two heating spirals 8 each comprising two sections 9 are arranged by means of twelve bottom elements 10. Each section of a heating spiral 9 is therefore fixed by three bottom elements 10. Each of the bottom elements 10 has the slotted half-cylinder shape described above and is positioned by means of its segments 19 put through the elongated apertures 20 in the panel elements 2 and fixed on the bottom side of the panel element 2 by means of wire loops 26. The wires 24 provided for fixing the heating spiral sections 9 on the bottom elements 10 are guided in the panel element and secured there at the front and the rear end of each bottom element 10 by means of orifices 4 provided there.

Figure 3:
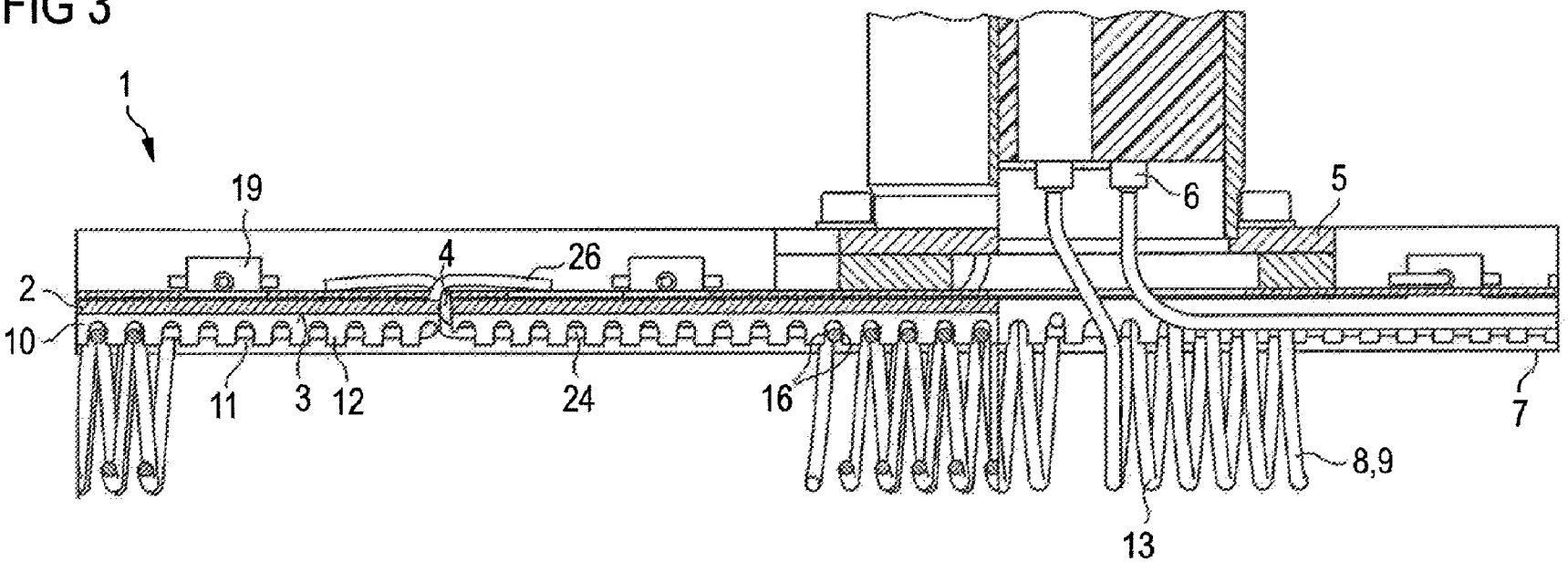
FIG. 3 shows a cross sectional view of the heater panel according to FIG. 2 taken along the line B-B.

The fixation of the bottom elements 10 and the heating spirals 8 on the bottom side 3 of the panel element can be seen in FIG. 3 which shows a section of the enlarged sectional view of the heater panel 1 according to FIG. 2. For reasons of clarity the heating spiral 8 is not fully shown so that the wires 24 for fixing the heating spiral 8 inside of the bottom elements 10 are also visible. In this sectional view the lateral contacts 16 provided at each spiral turn 13 and formed by the contact points between the bridges 12 of the bottom elements 10 and the respective spiral turn 13 can also be seen.

The invention claimed is:

1. A heater panel of a radiant heater comprising:

(a) a panel element;

(b) a heating spiral arranged on the panel element;

(c) said heating spiral being mechanically connected to the panel element with a portion of a spiral turn facing the panel element;

(d) each spiral turn is detachably connected to the panel element by three spaced-apart contact spots;

(e) two of the contact spots define two outer contacts located on an outer circumference of the spiral turn and a third contact spot defines an inner contact provided on an inner circumference of the spiral turn;

(f) said outer contacts have such a distance to each other that radii originating at said outer contacts define an angle of less than 180°; and (g) said inner contact is located within the portion of the spiral turn and is bounded by the two outer contacts and closer to the panel element than a reminder of the spiral turn.

2. The heater panel of a radiant heater according to claim 1, wherein at least a single spiral turn of the heating spiral is stabilised to avoid lateral tilting by additional contact spots defining lateral contacts located on a front side and/or on a rear side of the spiral turn as seen in direction of a longitudinal dimension of the heating spiral and on the portion of the spiral turn facing the panel element.

3. The heater panel of a radiant heater according to claim 1, wherein the contact spots comprise contact points.

4. The heater panel of a radiant heater according to claim 1, wherein the angle is greater than or equal to 45° and smaller than or equal to 120°.

5. The heater panel of a radiant heater according to claim 1, wherein the two outer contacts are formed by a slit in the panel element or in a bottom element extending in a direction substantially parallel to the panel element and connected to the panel element, length of the slit being smaller than outer diameter of a corresponding spiral turn and width of the slit being just so much larger than width of the corresponding spiral turn that the corresponding spiral turn can be inserted into the slit, and wherein the inner contact is formed by a brace element extending into the spiral turn and connected to the panel element or the bottom element.

6. The Heater panel of a radiant heater according to claim 5, wherein the brace element extends through a plurality of adjacent spiral turns and is parallel to the panel element between a first and a last spiral turn.

7. The heater panel of a radiant heater according to claim 5, wherein the bottom element provides bridges between slits and at least a part of the bridges protrudes above a surface of the panel element or the bottom element.

8. The heater panel of a radiant heater according to claim 7, wherein the bridges protrude above a deepest point of the inner circumference of the spiral turn by an amount corresponding to height of the cross section of the brace-like element.

9. The heater panel of a radiant heater according to claim 1, wherein the outer contacts are formed by outer rod shaped elements extending on both sides adjacent to and along the heating spiral and/or the inner contacts are formed by an inner rod-like element extending through a plurality of spiral turns, the outer rod shaped elements and/or inner rod shaped element being connected to the panel element.

10. The heater panel of a radiant heater according to claim 9, wherein lateral contacts are formed by at least two brackets connected to the panel element and fixing the inner rod shaped element in the spiral turn.

11. The heater panel of a radiant heater according to claim 1, wherein the heating spiral is a helical jacket heating pipe.

12. The heater panel of claim 1 wherein said portion of said spiral turn bounded by the outer contacts avoids contacting the panel element.

* * * * *

UNITED STATES PATENT AND TRADEMARK OFFICE

CERTIFICATE OF CORRECTION

PATENT NO. : 7,521,654 B2
APPLICATION NO. : 11/620860
DATED : April 21, 2009
INVENTOR(S) : Heinrich et al.

It is certified that error appears in the above-identified patent and that said Letters Patent is hereby corrected as shown below:

On the title page:

Title (54): Delete "HEATER PANEL OF A RADIANT HEATHER COMPROMISING A HEATING SPIRAL" and insert -- HEATER PANEL OF A RADIANT HEATER COMPRISING A HEATING SPIRAL --

In the claims:
Claim 6, Col. 8. Line 1: Delete "The Heater panel" and insert -- The heater panel --

Signed and Sealed this

Twenty-eighth Day of July, 2009

John Doll

JOHN DOLL
*Acting Director of the United States Patent and Trademark Office*

UNITED STATES PATENT AND TRADEMARK OFFICE

CERTIFICATE OF CORRECTION

PATENT NO. : 7,521,654 B2
APPLICATION NO. : 11/620860
DATED : April 21, 2009
INVENTOR(S) : Heinrich et al.

It is certified that error appears in the above-identified patent and that said Letters Patent is hereby corrected as shown below:

On the title page, Item (54) and Column 1, lines 1 and 2:

Delete "HEATER PANEL OF A RADIANT HEATHER COMPROMISING A HEATING SPIRAL" and insert -- HEATER PANEL OF A RADIANT HEATER COMPRISING A HEATING SPIRAL --

In the claims:
Claim 6, Col. 8. Line 1: Delete "The Heater panel" and insert -- The heater panel --

This certificate supersedes the Certificate of Correction issued July 28, 2009.

Signed and Sealed this

Eighteenth Day of August, 2009

David J. Kappos

David J. Kappos
*Director of the United States Patent and Trademark Office*